United States Patent [19]

Ho

[11] 3,984,973

[45] Oct. 12, 1976

[54] DIGITAL WATCH WITH LIQUID CRYSTAL AND LIGHT EMITTING DIODE DISPLAYS

[75] Inventor: Ernest C. Ho, Newport Beach, Calif.

[73] Assignee: Hughes Aircraft Company, Culver City, Calif.

[22] Filed: Mar. 13, 1975

[21] Appl. No.: 558,183

Related U.S. Application Data

[63] Continuation of Ser. No. 410,744, Oct. 29, 1973, abandoned.

[52] U.S. Cl. ..... 58/50 R; 58/4 A; 58/58

[51] Int. Cl.[2] ..... G04B 19/30; G04B 19/24

[58] Field of Search ..... 58/4 A, 50 R, 58

[56] References Cited

UNITED STATES PATENTS

| | | | |
|---|---|---|---|
| 3,668,861 | 6/1972 | Mitsui | 58/50 R |
| 3,672,155 | 6/1972 | Bergey et al. | 58/50 R |
| 3,747,322 | 7/1973 | Eckenrode et al. | 58/50 R |
| 3,765,163 | 10/1973 | Levin et al. | 58/50 R |

*Primary Examiner*—E. S. Jackmon
*Attorney, Agent, or Firm*—Fay I. Konzem; William H. MacAllister

[57] ABSTRACT

A digital watch system with a dual display demultiplexer, a liquid crystal display for use in daylight or bright light and a light emitting diode display for use in dim light. The digital watch system includes a crystal oscillator with frequency division which controls a set of counters, each counter carrying coded horological data. Selected counter data is multiplexed into a seven segment decoder which is then demultiplexed into memories, one for each of the segments in each of the liquid crystal display digits. These memories then control segment drivers for the liquid crystal digital displays. In parallel with the liquid crystal demultipliexer, the seven segment decoder outputs operate segment and digit drivers which drive light emitting diodes as a second display for the digital watch.

7 Claims, 2 Drawing Figures

DIGITAL WATCH WITH LIQUID CRYSTAL AND LIGHT EMITTING DIODE DISPLAYS

This is a continuation of now abandoned application Ser. No. 410,744, filed Oct. 29, 1973.

BACKGROUND OF THE INVENTION

1. Field of the Invention

This invention relates to digital electronic watches, and more particularly to a digital watch having a liquid crystal and light emitting diode (LED) display element, capable of displaying horological data.

2. Description of the Prior Art

In the art, LED displays have been employed as display elements for digital electronic watches, however, several drawbacks exist with this type of watch. One drawback is that it is difficult to read the LED display in sunlight or in high intensity artificial light. Another drawback with the LED watch is that since a large amount of electric power is required to operate the LED's, the prior art watches are designed to display the horological data only upon demand of the user, by the user pressing an actuation button, in order to limit power consumption.

In the prior art, liquid crystal display elements have also been used for digital electronic watches, as disclosed in application Ser. No. 364,794, filed May 29, 1973, entitled, "Digital Watch With Liquid Crystal Display." Said patent application assigned to the same assignee as the present patent application, Hughes Aircraft Company. The subject matter of this cross-reference is incorporated herein in its entirety. A major drawback with the digital watches with a liquid crystal display is that it is difficult to read the display in dim light, and it is not readable whatsoever in the dark because liquid crystals only reflect and do not emit light.

SUMMARY OF THE INVENTION

The digital electronic watch, in accordance with the invention, consists of a LED and a liquid crystal display device each capable of displaying horological data. The liquid crystal display device can be arranged to show hours and minutes continuously and by means of pushbuttons, the liquid crystal device can display either seconds or the date. A pushbutton is also employed which will actuate the LED display. This LED display could be used in dim light or in the dark when there was insufficient light to read the liquid crystal display.

Accordingly, it is an object of this invention to provide a digital watch with a liquid crystal display for continuously displaying horological data. It is another object to provide a digital watch with selectors for displaying either seconds or the date on the liquid crystal display element. It is a further object to provide a digital watch with a selector for displaying the hours and minutes on a LED display device, for viewing the time at night or in dim light. It is a further object to employ an oscillator, together with frequency dividers and counters to provide a plurality of different kinds of horological information which can be selectively displayed upon a single liquid crystal display set. It is a further object to provide a multiplexing arrangement in connection with horological information counters together with counter information decoders so that the number of decoders can be reduced through multiplexing. It is a further object to provide a digital watch circuit which includes a decoded and multiplexed series of horological signals which are thereupon demultiplexed and fed to memory units for each portion of the display so that the memories each control drive to their own portion of the display in accordance with the multiplexed information. It is a further object to provide a digital watch circuit which simultaneously takes the decoded and multiplexed series of horological signals which thereupon operate segment and digit drivers which drive LED display elements in accordance with the multiplexed information.

The features of the present invention which are believed to be novel are set forth with particularity in the appended claims. The present invention, both as to its organization and manner of operation, together with further objects and advantages thereof, may be understood best by reference to the following description, taken in connection with the accompanying drawings.

A BRIEF DESCRIPTION OF THE DRAWINGS

DETAILED DESCRIPTION

Figure 1:
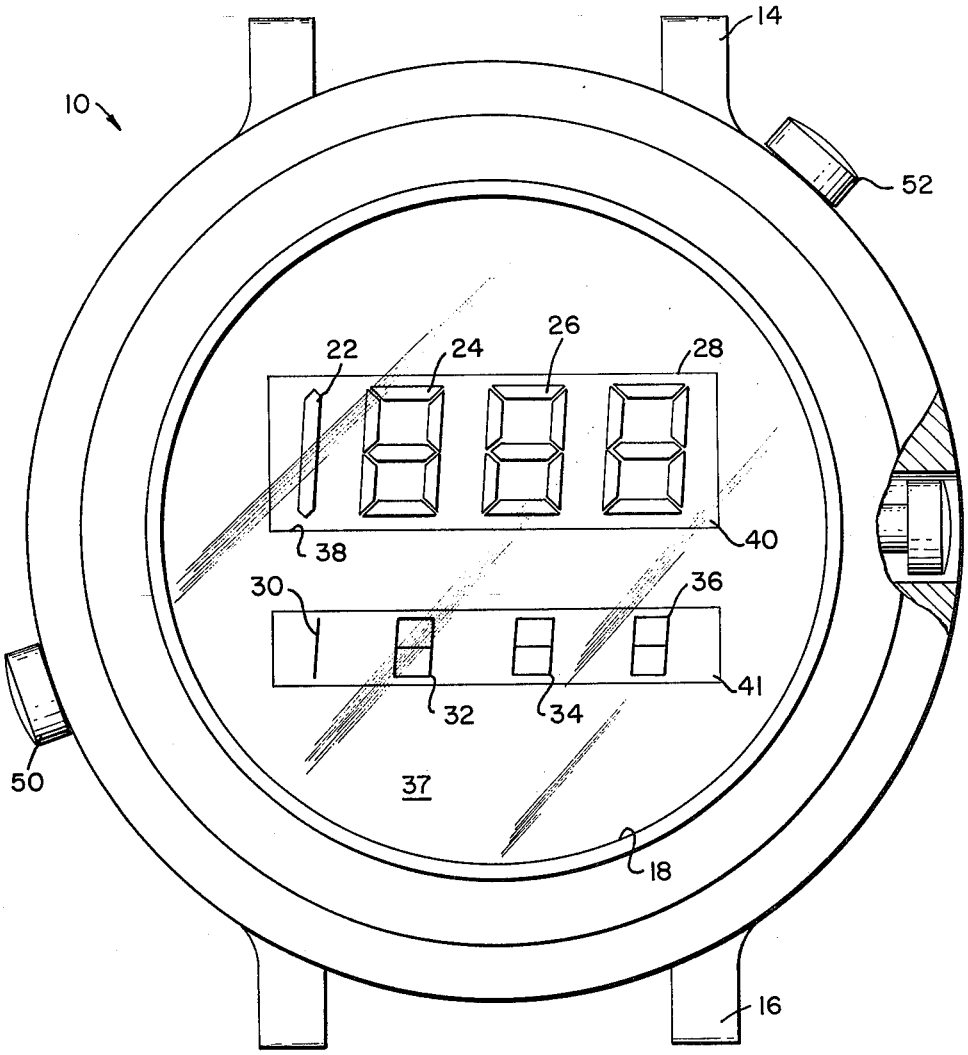
FIG. 1 is a top-plan view of a digital watch with a liquid crystal and a LED display which selectively displays different horological information, in accordance with this invention.

Referring now to FIG. 1, the digital watch 10 includes selective electronic circuitry and liquid crystal and LED displays. Digital watch 10 has a case 12 which is provided with watch strap-securing ears 14 and 16. The securing ears 14 and 16 are of such nature that the usual watch strap can be attached thereon so that watch 10 can be carried upon the wrist of the wearer. In the preferred embodiment, the watch 10 is thus a wristwatch, although the same construction, circuitry and display can be employed in a pocket watch. Compact size batteries (not shown) are mounted on the back of the watch to supply power to the electronic circuitry. Crystal 18 is mounted on the front of the watch case 12. Crystal 18 can be of any color filter to enhance the contrast of the liquid crystal and the LED displays. Through the crystal can be seen a mask 37 which has a display-viewing window 38 therein. Viewed through this display-viewing window 38 is liquid crystal module 40 which contains liquid crystal devices 22, 24, 26 and 28.

The digital watch of this invention utilizes a 3-½ or 4-digit liquid crystal display which remains on continuously, displaying hours and minutes, (in the preferred embodiment) except when commanded by a pushbutton. When it is desired to display either the date of the month, the month and date, or the seconds, the hours-minutes display is blanked out and the date, month, or seconds is selectively displayed by selectively actuating pushbuttons.

The liquid crystal display devices 24, 26, and 28 are each a standard 7-segment liquid crystal display, so that, when the selected segments are energized, the 10 digits 0–9 can be represented accordingly. Display device 22 displays a numeral one, which is only activated during the 10th, 11th, and 12th hours.

The digital watch of this invention also employs a 3-½ or 4-digit LED display, positioned directly below the liquid crystal display. The LED display devices 32, 34, and 36 are each a standard seven-segment display, which when energized, selectively represent the 10 digits from 0–9. LED display device 30 displays a numeral one. The four LED displays are activated by means of manually operated pushbuttons 50 and 52. These LED displays show hours and minutes when pushbuttons 50 and 52 are depressed simultaneously. If desired, additional pushbuttons may be used to display the seconds or the date on the LED's.

Watchcase 12 carries manually operable pushbuttons 50 and 52, which are easily accessible. Furthermore, case 12 carries recessed pushbutton 54 which can be depressed by a pointed object for the purpose of setting the clock by affecting the horological data appearing at the display. In accordance with the functional requirements, more or less pushbuttons can be employed for the purpose of controlling the watch. The physical structure of the watch module substrate 41 is not visible in the liquid crystal display window, but is visible in the LED display window. The physical structure of the substrates upon which the display devices are mounted and the relationship of the pushbuttons 52 and 54 to the substrates and to the circuit are disclosed in detail in I. B. Merles and R. F. Zurcher application Ser. No. 343,319, filed Mar. 21, 1973. The subject matter of this crossreference is incorporated herein in its entirety. Said patent application assigned to the same assignee as the present patent application, Hughes Aircraft Company.

Figure 2:
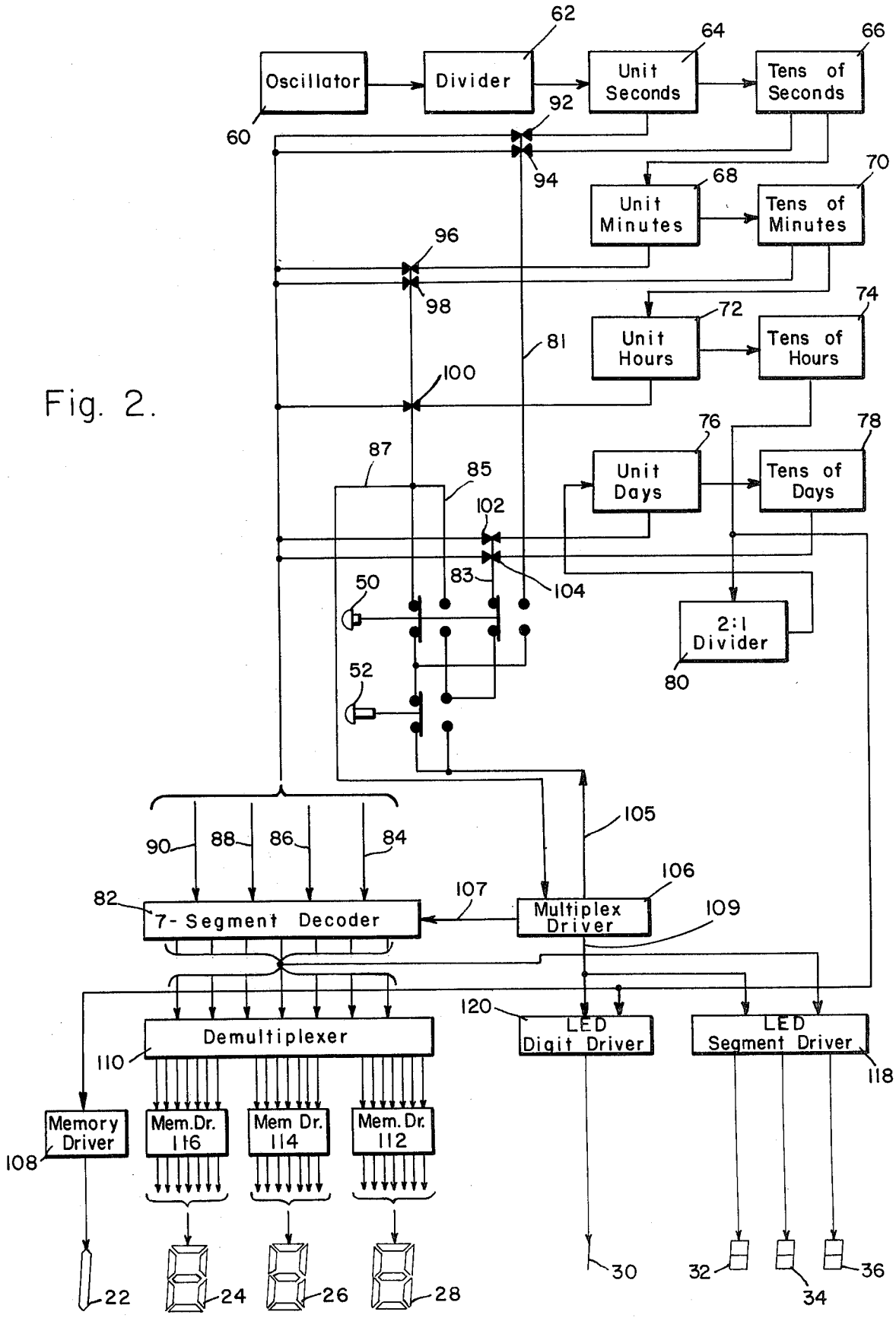
FIG. 2 is a block diagram of the circuitry of the digital watch of this invention.

An electronic circuit 58 employed in the digital watch of FIG. 1 is depicted in FIG. 2. Said circuit consists of an electronic oscillator 60 which is crystal-controlled to oscillate at a predetermined and substantially constant frequency. It, as well as the other circuits of this invention, are powered by two compact size batteries mounted on the bottom of the watch so that the entire structure can be mounted in a wristwatch or similar device. Several or all of the subcircuits can be and preferably are contained on the same CMOS circuit chip to minimize assembly labor and chances of misassembly, minimize size, and provide a watch of maximum reliability. The output from the crystal controlled oscillator 60 is driven into a standard CMOS divider 62 which results in an output pulse of one cycle per second. This one hertz pulse is then driven into the unit seconds counter 64, which is a standard CMOS decode counter, which counts up to 10 (0–9). The unit second counter in turn drives the CMOS tens-of-seconds counter 66 which must count up to six (0–5) to satisfy the requirement of 60 seconds per minute. All successive counters are designed so that at the end of each counter's normal count sequence a pulse is sent to the next counter in the sequence. This counter sequence can be thought of as a consecutive chain of dividers from which various points in the divider chain may be tapped to produce the desired seconds, minutes, hours, and date outputs. All outputs taken from the counters are standard 1, 2, 4, 8 (4 bit) binary coded decimal. Similar to the unit seconds counter's operation, the tens-of-seconds counter 66 drives the unit minutes counter 68, which is a decode counter. The unit minutes counter 68 then drives the tens-of-minutes counter 70, which counts up to six. The tens-of-minutes counter 70 then drives the unit hours counter 72, which is a decode counter. Continuing the chain of divide counters, the unit hours counter 72 then drives the tens-of-hours counter 74.

The present disclosure contemplates a 12-hour watch. Therefore, the tens-of-hours counter controls the tens-of-hours "number 1" display device 22, and does not need to count beyond that logic state. It is a special counter which is controlled by the unit-hours counter 72 to illuminate the tens-of-hours display device 22 for the 10th, 11th, and 12th hours. Thereupon, it resets. Similarly, it is interconnected with the unit-hours counter 72 so that, when the tens-of-hours counter 74 resets at the end of the 12th hour, the unit-hours counter 72 does not reset to zero, but resets to 1. Thus, there is mutual intercontrol between counters 72 and 74.

The output signal from tens-of-hours counter 74 occurs twice a day. This output is connected through divider 80 to the input of unit-days counter 76. Therefore, the unit-days counter 76 advances only once per day.

Divider 80 stores the information as to whether or not it is ante-meridian or post-peridian.

Unit-days counter 76 thus receives a signal every day and emits a signal every 10 days. Tens-of-days register counter 78 need only reach 3, and thus does not need all of the binary coded decimal circuits to make it sufficiently complete to perform the other tasks. Tens-of-days counter 78 is linked to unit-days counter 76 so that, when the total attempts to pass 31 days, counter 78 resets to zero and counter 76 resets to one. It should be noted that tens-of-hours counter 74 and tens-of-days counter 78 do not need a zero signal output. When they are set at zero, no output to the display devices is required.

Seven-segment decoder 82 is a device which receives binary coded decimal signals from the counters and emits seven signals which correspond to the seven segments of the liquid crystal and the LED display devices so that, when turned on to be visibly distinctive, the segments represent the digit corresponding to the counter state. Since it is desired to display different horological information, it is necessary to switch different counters into the input of the seven-segment decoder. For convenience a single seven-segment decoder 82 is employed, and the inputs and outputs therefrom are multiplexed.

There are four input buses 84, 86, 88, and 90 to the seven-segment decoder, each of these buses represent four lines which carry the binary coded decimal information from the counters. Transmission gates 92, 94, 96, and 98, respectively, connect counters 64, 66, 68, and 70 to buses 84, 86, 88, and 90. Similarly, transmission gates 100, 102, and 104 respectively connect counters 72, 76, and 78 to buses 84, 86, 88, and 90. The gates are all connected to multiplex driver 106 by line 105.

Multiplex driver 106 has three outputs, line 105, line 107, and line 109. Line 107 controls the liquid crystal displays 24, 26, and 28. Under normal operating conditions, the multiplex driver 106, in combination with decoder 82, operates in such a manner that its output, line 105, delivers clock pulses to the transmission gates so that signals are delivered to decoder 82. The multiplexing sequentially delivers signals corresponding to unit-minutes to be displayed on liquid crystal device 28, tens-of-minutes to be displayed on device 26, unit-hours on device 24. The tens-of-hours is directly delivered from tens-of-hours counter 74 to display device 22.

Thus, in normal operation, multiplex driver 106 operates the transmission gates in such a manner that the binary coded decimal bit lines 84, 86, 88, and 90 receive the BCD digital code bit when the unit-minutes counter 68 is connected to the input bit lines by "on" condition of transmission gate 96 and its companions. The output of seven-segment decoder 82 represents the energization of the necessary lines for the seven segments to be displayed in device 28. However, the output from the seven-segment decoder 82, which is going to the liquid crystal displays must be demultiplexed to drive the continuous current liquid crystal display. The demultiplexer 110 has as its input the seven-segment lines and digit select information from driver 106, via line 107. The demultiplexer 110 has as its output seven-segment lines for each of the devices 24, 26, and 28. Memory-drivers 112, 114, and 116 are connected in these lines between the demultiplexer and respectively the devices 28, 26, and 24. Demultiplexer 110 is controlled by multiplex driver 106 so that the seven-segment decoder information is properly distributed to the memory-driver devices. The memory-drivers continuously energize selected segments.

When a different display is desired, pushbutton 50, for example, is depressed. Pushbutton 52 controls multiplex driver 106 so that the unit-days and tens-of-days counters 76 and 78 are scanned, instead of the minutes and hours counters. In this case, the days stored in these counters are displayed. It is preferable to display the unit-days and tens-of-days on devices 28 and 26, respectively, when a 3-½ digit display is employed, as in the preferred embodiment shown. Thus, the minutes and hours are not displayed while pushbutton 50 is depressed, but the days recorded in the days counters are displayed. Similarly, if display of the seconds is desired, depressing pushbutton 50 will activate multiplex driver 106 so that the unit-seconds and tens-of-seconds information stored in counters 64 and 66 are scanned in BCD form and are displayed in devices 28 and 26 in seven-segment form. Furthermore, if additional counters were incorporated, by simple extrapolation from the disclosed counters, the month could be displayed with the day's date. Furthermore, with the use of another pushbutton and appropriate counters, other horological information such as the year could be displayed in similar manner.

In operation when pushbuttons 50 and 52 are unactuated, the multiplex driver 106, via line 105, sequentially opens transmission gates 96, 98, and 100, allowing the information from unit minutes counter 68, tens-of-minutes counter 70, and unit hours counter 72, respectively, to be delivered to the 7-segment decoder 82 through the demultiplexer 110 through their respective memory drivers and finally to be displayed on liquid crystal elements 28, 26, and 24, respectively.

When pushbutton 50 is depressed, the output 105 from multiplex driver 106 is connected via line 81 to transmission gates 92 and 94 which are connected to unit seconds counter 64 and tens-of-seconds counter 66, respectively. When pushbutton 50 is actuated or depressed, multiplex driver 106 sequentially delivers a signal to open transmission gate 92 and then transmission gate 94, respectively, deliver the information from unit seconds counter 64 and tens of seconds counter 66 to decoder 82 and finally to display elements 28 and 26, respectively.

When pushbutton 52 is depressed, output 105 from multiplex driver 106 is connected via line 83 through transmission gates 102 and 104 to unit days counter 76 and tens-of-days counter 78. When pushbutton 52 is depressed, multiplex driver 106 sequentially delivers a signal to open transmission gate 102 and then transmission gate 104, the information from unit days counter 76 and tens-of-days counter 78 is respectively delivered through decoder 82 and the demultiplexer 110 to display elements 28 and 26. Output 107 from multiplex driver 106 determines which liquid crystal display element will receive the information from the 7-segment decoder 82. Display element 28 receiving the information from the unit days counter 76 and display element 26 receiving the information from tens-of-days counter 78, when pushbutton 52 is depressed.

The output from 7-segment decoder 82 must be demultiplexed to drive the continuous current liquid crystal displays 28, 26, and 24. Memory drivers 112, 114, and 116 continuously energize liquid crystal display elements 28, 26, and 24, respectively. Even when a transmission gate is closed, thereby impeding information from that counter to its display element, the memory driver for that display element will maintain the previous information received from the counter when that counter's transmission gate was last opened.

Finally, when both pushbuttons 50 and 52 are depressed simultaneously, output 105 from multiplex driver 106 is connected via line 85 through transmission gates 96, 98, and 100 to unit minutes counter 68, to tens-of-minutes counter 70 and to unit hours counter 72, respectively. When pushbuttons 50 and 52 are depressed simultaneously, multiplex driver 106 sequentially delivers a signal to open transmission gate 96, 98, and 100, the information from unit minutes counter 68, tens-of-minutes counter 70 and unit hours counter 72 is respectively delivered through decoder 82 to the LED segment driver 118 and finally is displayed on LED display elements 36, 34, and 32, respectively. Output 109 from multiplex driver 106 determines which LED display element will receive the information from the 7-segment decoder 82. Display element 36 receiving the information from the unit minutes counter 68, display element 34 receiving the information from the tens of minutes counter 70 and display element 32 receiving the information from the unit hours counter 72.

The other output of multiplex driver 106 is line 109, which controls the operation of the LED displays 30, 32, 34, and 36. Under normal operating conditions line 109 does not deliver any horological information to the LED displays. But when pushbuttons 50 and 52 are depressed, lines 105 and 109 supply multiplex clock signals so that the transmission gates scan the minutes and hours data and transmit them in multiplex to decoder 82 which in turn delivers unit-minutes through LED segment driver 118 to be displayed on LED device 36, tens-of-minutes to be displayed on device 34, unit-hours on device 32, and tens-of-hours on device 30. The tens-of-hours counter 74 is directly connected through driver 120 to device 30. It does not enter into the function performed by seven-segment decoder 82. Pushbuttons 50 and 52 and the LED displays are usually employed when the hours and minutes are desired to be viewed in dim light. If desired, additional pushbuttons may be used to display the seconds or the date on the LED's. Pushbutton 54 is employed with pushbuttons 50 and 52 for setting the counters so that the counters carry current time.

Line 105 represents three lines, which are multiplexed between lines 81, 83, and 85. Pushbuttons 50 and 52 direct or channel the information from multiplex driver 106, via line 105, through the appropriate transmission gates.

Line 87 is connected in parallel with line 85 and feedsback information into multiplex driver 106. When both pushbuttons 50 and 52 are depressed, the digital information on line 85 is fed back to multiplex driver 106, which in turn converts the information to a DC signal, via line 109, which activates the power to LED segment driver 118 and LED digit driver 120.

The information out of demultiplexer 110 is in the form of seven-segment information. However, since the demultiplexer is a switching device, a memory-driver is necessary for each of the segment lines to provide continuous power to each of the segments to be illuminated.

Liquid crystal memory segment drivers 112, 114, and 116 provide continuous power to liquid crystal display devices 28, 26 and 24, respectively. Liquid crystal digit driver 108 inputs data from the tens-of-hours counter 74. Driver 108 outputs continuous power to liquid crystal display device 22.

Liquid crystal display devices 22, 24, 26, and 28 are of conventional construction. The liquid crystal cell structure is a sandwich module 40. It is connected directly to the metalization circuit on the substrate which in turn is directly connected to the integrated circuit chips. The electrodes are thus integral with the printed circuitry on the substrate and they are thus directly connected to the chips. A nematic liquid is preferred as the controlling medium for the liquid crystal display. Liquid crystals are discussed in further detail in M. Braunstein and W. P. Bleha U.S. Pat. No. 3,732,429 and in T. D. Beard and W. P. Bleha U.S. Pat. No. 3,744,879. The details of the electronic circuitry are disclosed in more detail in Hans G. Dill U.S. Pat. No. 3,757,510. The subject matter of all outside disclosures referenced in this specification are incorporated herein in their entirety by this reference.

The output from the seven-segment decoder 82, which is going to the LED displays must be amplified. LED segment driver 118 has as its input the seven-segment lines and digit select information from driver 106, via line 109. LED segment driver 118 amplifies these inputs and outputs seven-segment lines for each of the LED devices 32, 34, and 36. LED digit driver 120 has as its input the tens-of-hours information from counter 74 and the digit select information from multiplex driver 106, via line 109. LED digit driver 120 amplifies these inputs and it outputs a numeral one to LED display device 30 at the correct time.

Although the device which has just been described appears to afford the greatest advantages for implementing the invention, it will be understood that various modifications may be made thereto without going beyond the scope of the invention, it being possible to replace certain elements by other elements capable of fulfilling the same technical functions therein.

What is claimed is:

1. A digital watch for displaying selectable horological information comprising:

first and second optical displays;

an electronic circuit for providing information to be selectively displayed on said displays, said electronic circuit comprising an oscillator, a frequency divider coupled to the output of said oscillator for producing a timing signal, and counters for receiving said timing signal and maintaining a plurality of sets of horological information;

a first and second control connected between said counters and said displays;

means for causing said first display to continuously display a first set of horological information when said first and second controls are unactivated and to display a second set of horological information on said first display when said first control is activated, also said means causes said second display to display said first set of horological information when said first and second controls are simultaneously activated.

2. A digital watch as recited in claim 1, wherein said first display comprises a plurality of liquid crystals devices.

3. A digital watch as recited in claim 1 wherein said second display comprises a plurality of light emitting diodes.

4. A digital watch as recited in claim 1, wherein said controls are manually operable.

5. A digital watch as recited in claim 1, wherein said means for causing said first and second displays to display comprises switching means for connecting counters containing the first set of horological information to said first display when said first and second controls are unactivated and for connecting counters containing said second set of horological information to said first display when said first control is activated and for connecting said counters containing said first set of horological information to said second display when said second control is activated.

6. A digital watch as recited in claim 5, wherein said first display comprises seven-segment liquid crystal display devices and a seven-segment decoder is connected to said counters and first display in parallel with said means for causing said first and second displays to display.

7. A digital watch as recited in claim 6, wherein said switching means comprises multiplexing means for multiplexing the counters containing the first set of horological information into said decoder when said first and second control means are unactivated, and for multiplexing the counters containing the second set of horological information into said decoder when said first control means is activated, and for multiplexing the counters containing the first set of horological information into said decoder when said second control means is activated; said switching means selects which liquid crystal will receive the horological information from said decoder and which light emitting diode will receive the horological information from said decoder.

* * * * *

UNITED STATES PATENT OFFICE

CERTIFICATE OF CORRECTION

Patent No. 3,984,973 Dated October 12, 1976

Inventor(s) Ernest C. Ho

It is certified that error appears in the above-identified patent and that said Letters Patent are hereby corrected as shown below:

In the Abstract:

"A digital watch system with a dual display demultiplexer," should read--A digital watch system with a dual display element,--.

In the Detailed Description:

Column 3, line 45, "decode counter, which counts up to 10 (0-9). should read--decode counter, which counts up to ten (0-9).--

Signed and Sealed this

First Day of February 1977

[SEAL]

*Attest:*

RUTH C. MASON
*Attesting Officer*

C. MARSHALL DANN
*Commissioner of Patents and Trademarks*